US009691365B2

(12) United States Patent
Pascale

(10) Patent No.: US 9,691,365 B2
(45) Date of Patent: Jun. 27, 2017

(54) GUITAR PICK

(71) Applicant: Steven Patrick Pascale, San Clemente, CA (US)

(72) Inventor: Steven Patrick Pascale, San Clemente, CA (US)

(73) Assignee: Steven Patrick Pascale, San Clemente, CA (US)

( * ) Notice: Subject to any disclaimer, the term of this patent is extended or adjusted under 35 U.S.C. 154(b) by 0 days.

(21) Appl. No.: 14/545,928

(22) Filed: Jul. 9, 2015

(65) Prior Publication Data

US 2017/0011720 A1 Jan. 12, 2017

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 1,547,560 A 7/1925 Burdwise
1,787,136 A 12/1930 Beauchamp
2,016,438 A 10/1935 Keoloha
2,484,820 A * 10/1949 Hyman ..... G10D 3/163 84/322
3,112,668 A * 12/1963 Moshay ..... G10D 3/163 84/322
3,319,505 A * 5/1967 Hyman ..... G10D 3/163 84/322
3,442,169 A 5/1969 Boweis
3,735,663 A 5/1973 Cowell
3,739,681 A 6/1973 Dunlop
4,102,234 A 7/1978 Brundage
4,253,372 A * 3/1981 Filipetti ..... G10D 3/163 84/322
4,270,433 A 6/1981 Adamec
D260,529 S * 9/1981 Pearse ..... 84/322
D268,844 S * 5/1983 McPherson, Sr. ..... 84/322
D317,617 S * 6/1991 Mutti ..... 84/322
D330,905 S * 11/1992 Thomas ..... 84/322
D355,667 S * 2/1995 Burger ..... 84/329
5,509,341 A 4/1996 Dunlop
D389,856 S * 1/1998 Everly ..... 84/322
5,905,217 A * 5/1999 Byers ..... G10D 3/163 84/320

(Continued)

*Primary Examiner* — Robert W Horn

(57) ABSTRACT

Guitar pick uniquely designed for "variability and versatility" strumming. The apparatus shape is ergonomic and designed to optimize human factors i.e. musical transfer of energy from pick to strings in an ideal manner. The apparatus picking surface and corresponding tip(s) can take advantage of an array of material(s) while utilizing a rubber-like grip. Furthermore, the invention contains three equally spaced lobes with at least one lobe being defined with a continuous rounded edge-surface. Collectively, the guitar pick has three different lobe tips located along various radial(s) positioned at 360-135-225 degrees (reference to a 360 degree circle) with a predetermined distance from center point to individual lobe tip. Moreover, each planar lobe runs along the picks longitudinal as well as lateral axis and can utilize different material gauges. Rotation of the guitar pick i.e. moving from lobe to lobe . . . is achieved utilizing grooves that are geometrically relational to the union between each plane.

5 Claims, 7 Drawing Sheets

(56) References Cited

U.S. PATENT DOCUMENTS

D412,010 S * 7/1999 Lindley ..... 206/820
D490,459 S * 5/2004 Sarmas ..... D17/20
6,777,602 B2 * 8/2004 Hautamaki ..... G10D 3/163 84/320
6,815,597 B1 * 11/2004 Bosley ..... G10D 3/163 84/322
7,067,729 B2 * 6/2006 Leong ..... G10D 3/163 84/320
7,078,604 B2 * 7/2006 Rapaport ..... G10D 3/163 84/322
7,145,066 B1 * 12/2006 Moreland ..... G10D 3/163 84/320
7,238,869 B1 * 7/2007 Kleckzka ..... G10D 3/163 84/322
D557,330 S * 12/2007 Parikh ..... D17/20
7,459,620 B1 * 12/2008 Kester ..... G10D 3/163 84/322
7,462,768 B2 * 12/2008 Newmaster ..... G10D 3/163 84/322
8,097,799 B2 * 1/2012 Tran ..... G10D 3/163 84/322
8,134,059 B2 * 3/2012 Zink ..... G10D 3/163 84/320
D673,999 S * 1/2013 Walker ..... D17/20
8,389,838 B2 * 3/2013 Aletto ..... A61B 17/8805 84/320
D688,736 S * 8/2013 Lilly ..... D17/20
D697,707 S * 1/2014 Surabian ..... D3/204
8,642,864 B2 * 2/2014 Bordelon ..... G10D 3/163 84/322
2004/0187372 A1 * 9/2004 Dorizas ..... G09F 1/12 40/661
2007/0006713 A1 * 1/2007 Dunlop ..... G10D 3/163 84/322
2010/0031549 A1 * 2/2010 Kenyon ..... G09F 7/04 40/711
2013/0092008 A1 * 4/2013 Murphy ..... G10D 3/163 84/322
2014/0130388 A1 * 5/2014 McCormick ..... G09F 21/048 40/591

* cited by examiner

GUITAR PICK

BACKGROUND OF THE INVENTION

1. Field of the Invention

The present invention relates generally to accessories for music instruments; particularly, a guitar pick.

2. Description of Related Art

Guitar picks can vary tremendously. Finding the right pick is sometimes like finding the perfect guitar—you have to try a lot of them until you find just the right one. Prior patents elaborate on a a variety of plectrums currently being manufactured coupled with the use of several types of resilient materials . . . including plastic. Interestingly, for many guitarist, the ultimate pick material might very well be tortoise shell, but this type of structure composition is no longer available. Today, more widely used materials incorporates a hybrid of varying degrees of nitrocellulose and camphor, Delrex, poly carbonate as well as nylon. Nevertheless, an ideal composition remain an individual preference.

Professional guitarist alike would agree that a plectrum is a very an important choice when considering playability. Some players go so far as to say that a pick has the biggest impact on both tone as well as technique. In particular, striking strings sets the audio signal in motion.

With this in mind, playing in a linear single-note legato fashion . . . minimizes the crisp attack that maybe heavier picks impart. Upstroke ghost notes . . . to rhythm, a thinner pick provides a more ethereal subtlety or keeps a battery of eighth-notes going in order to build tension. That said, regardless of the genre of music played, a pick provides an essential tonal foundation.

Indeed, companies like Fender, Dunlop, D'Andrea and Ernie Ball have been around for decades. Newer companies are emerging that include Dava, Red Bear Trading, Clayton, V-Picks, Wegen, JB, Blue Chip, Golden Gate, Pick Boy, Wedgie and more. Generalizations about technique and materials are plentiful. By and large, most electric guitarists use some form of plastic or nylon. Luigi D'Andrea first began making guitar picks from cellulose acetate back in 1922. To this day it has remained one of the standard materials for guitar picks. Along the same lines, Ernie Ball's standard line of Cellulose Acetate Nitrate picks are also common place. Some pick purists swear by Dunlop's Tortex line which is made from plastics to emulate properties found in a turtle shell . . . . In other cases, polymerized animal protein has been known to simulate the same. Likewise, nylon picks have been used by many including Jimmy Page, Dave Gilmour, and Gene Simmons. Nylon arguably has a brighter sound and also has more flexibility than comparable thick plastic picks. So looking back, nylon may appeal to players who's aim includes a more vintage sound as they seem less suited to the kind of compressed tone and tight rhythm phrasing that modern rock gravitates towards.

Indeed, a thinner gauge tends to be more flexible and produces a wide range of sounds from soft to loud, but also produces a click that emphasizes the attack of the pick. On the other hand, a heavier (thicker material gauge) pick will tend to produce a brighter tone.

Meanwhile, exotic materials can produce aesthetically beautiful alternative tones.

These guitar picks may include: lignum vitae wood, zebrawood, walnut, bubinga and gemstones. In general, the harder and denser the material, the more crisp and cutting the resulting sound.

Examples of conventional finger picks for playing stringed musical instruments may be seen by referring to one or more of the following United States patents:

U.S. Pat. No. 1,547,560 Burdwise July 1925; U.S. Pat. No. 1,787,136 Beauchamp December 1930; U.S. Pat. No. 201,648 Kealoha October 1935; U.S. Pat. No. 3,442,169 Bowers May 1969; U.S. Pat. No. 3,739,681 Dunlop June 1973 U.S. Pat. No. 3,735,663 Cowell May 1973; U.S. Pat. No. 4,102,234 Brundage July 1978; U.S. Pat. No. 4,270,433 Adamec June 1981; U.S. Pat. No. 5,509,341 Dunlop April 1996

Whatever guitar material that is used, a thinner pick (somewhere between 0.40 and 0.65 mm) is likely to use standard materials like Delrin and nylon—which will generally have a lighter sound and theoretically works better for acoustic strumming where a more trembly tone is desired. These materials are also great for acoustic guitar zing sound that is useful in rock, pop, and country recordings for filling in a midrange and helping to define rhythms. Conversely, thin picks make little sense for rock rhythm guitars or lead; as they deliver very little bass or midrange tone and simply lack the heft necessary to bring out a well-rounded tone on single-note leads. For that, a step up to a medium gauge pick is warranted material thickness generally in the range of 0.60 to 0.80 mm. A medium gauge remains the most popular thickness because it's the perfect combination of stiffness and flexibility for rock rhythm in addition to full bodied acoustic accompaniment (especially in solo situations). What's more, thicknesses ranging from 0.70 mm-0.99 will have enough heft to produce powerful tones on leads and hook figures. In all, medium picks tend to produce a good blend of high-end and lower mid-range thump, without being too shrill.

Finally, for heavier sounds . . . a material gauge ranging from 1.05 mm-1.35 mm works well while still flexible enough to crunch rhythms and at the same time firm enough for full-bodied chord arpeggios and fat lead lines. It's noteworthy just how much one's tone changes in switching from a medium to a thick pick. At the thicker end, somewhere between 1.5 to 2.5 is an ideal thickness for bebop and jazz—sounds that are increasingly mellow and burnished.

Electric players who want more precision and control will gravitate toward heavier picks with a pointier tip.

Although it's probably one of the most overlooked aspects of a pick selection . . . (given tone, playability, velocity), from a tonal perspective, the texture of a guitar pick is very important as well. Many pick designs including Dunlop's traditional nylon and max grip picks are intended to help maintain a better hold.

Finally, a picks characteristics are associated with the style of music being played. Ultimately, an acoustic chord strummer will generally want to use a thin pick, probably one made of cellulose, delrin, or imitation tortoiseshell. Acoustic flat-pickers like to play music in a more intricate style and while playing single note lines. Electric rock players certainly favor medium to heavy gauge picks with a sharp tip. Classic and rock players typically use nylon or cellulose, while metal and grunge aficionados steer toward delrin or acrylic. As mentioned, regardless of genre, if accuracy and precision are important, a hard pick is preferred.

REFERENCES CITED

U.S. Patent Documents

U.S. Pat. No. 1,547,560 July 1925 Burdwise
U.S. Pat. No. 1,787,136 December 1930 Beauchamp U.S. Pat. No. 201,648 October 1935 Kealoha
U.S. Pat. No. 3,442,169 May 1969 Bowers
U.S. Pat. No. 3,739,681 June 1973 Dunlop
U.S. Pat. No. 3,735,663 May 1973 Cowell
U.S. Pat. No. 4,102,234 July 1978 Brundage
U.S. Pat. No. 4,270,433 June 1981 Adamec
U.S. Pat. No. 5,509,341 April 1996 Dunlop
U.S. Pat. No. 7,462,768 December 2012 Newmaster; Josiah
U.S. Pat. No. 268,844 May 1983 McPherson, Sr.; Mathew
U.S. Pat. No. 2,484,820 October 1949 Hyman, Galetzky
U.S. Pat. No. 5,905,217 May 1999 Byers; Michael A
U.S. Pat. No. 813,459 March 2012 Zink, Braxton W.
U.S. Pat. No. 8,642,864 February 2014 Bordelon, Kirt

SUMMARY OF THE INVENTION

According to the first embodiment of the invention, a finger pick is disclosed for plucking or strumming a guitar. The apparatus seen provides a novel ergonomic design which was enthusiastically received during primary market research.

In another embodiment, the apparatus depicts different radius tips located on all three lobes in an unbounded shape. Each lobe containing a durable material or brid and is accompanied with a silicone like rubber grip. Furthermore, each lobe has at least 1 radius.

In another embodiment, the invention provides a means for including a logo on either side of the guitar pick.

A better understanding of the present invention will be understood upon reference of the following detailed description and review of accompanying drawings; wherein features and advantages are illustrated.

SPECIFICATIONS

Figure 1:
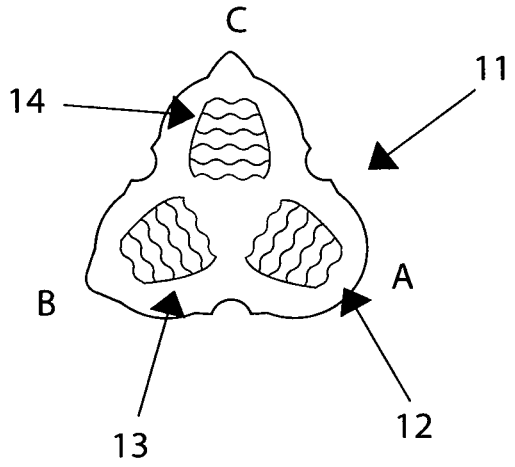
FIG. 1 is a front view of the guitar pick in accordance with the invention.

A guitar pick according to a first embodiment referenced in FIG. 1. The pick 11 illustrates an apparatus with a somewhat triangular shape that is designed to be held between the guitar players thumb and finger(s). Other designs, materials, and combinations are possible and this disclosure is not meant to be limiting to the invention described herein. The invention . . . 11 is comprised of three lobes which are approximately 0.750 inches from side to side and are noted herein as 12, 13, and 14.

Figure 2:
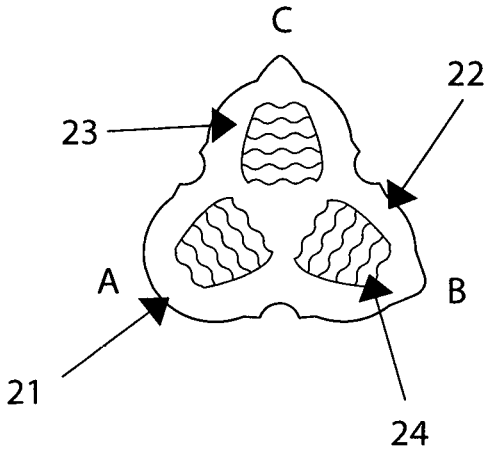
FIG. 2 is a rear view of the guitar pick shown in FIG. 1.

FIG. 2 illustrates a round lobe "A" with a radius that defines tip 21. As illustrated, 23 depicts lobe"C" with a pointed tip projection. Furthermore, 22 depicts lobe "B" with a somewhat pointed tip projection.

A lead guitarist that is shredding, playing rhythm or riffs, and thrashing metal is more opt to insist on a more pointed projection and material thickness (0.95 mm-1.15 mm).

As shown in 24, lobe"B" has a grip pad with a designated pattern which stems outward from the mid-point of said pick, the grip is situated approximately ⅛" from the bottom corner of the other 2 grip base sections, said surfaces raised with a "rubber-like" silicone material.

Figure 3:
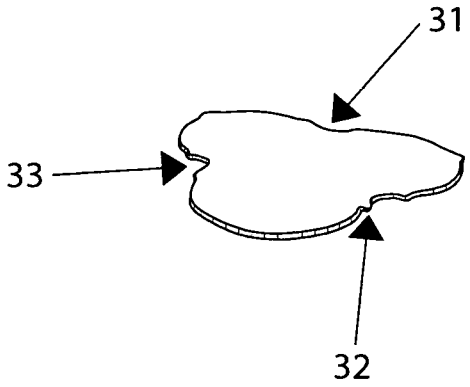
FIG. 3 is a perspective front view of the apparatus front-side shown in FIG. 1.

As best shown in FIG. 3, the pick allows a guitar player to transition from one lobe "tip" to another while in play. Designed with human factors in mind, the grooves allow for movement of the pick to a desired tip at either 360 degrees (0) lobe A, 135 degrees lobe B, or 225 degrees for lobe C as shown in FIG. 2. Selection of a given tip and corresponding gauge is based on a style of play desired.

Said recess openings 31, 32 and 33 functionally assist a guitar player to rotate the given pick either clockwise and/or counter clockwise pending on a subsequent style and tone required. The lip situated on pick wheel seen in 32 represents a geometrical union between lobe"A" and lobe "B".

Noteworthy, 31 represents a union between lobe"B" and lobe "C"; while 33 between lobe"A" and "C". If the invention is made of varying gauge(s), the transition is also felt by the slight gradation in material thickness.

Figure 4:
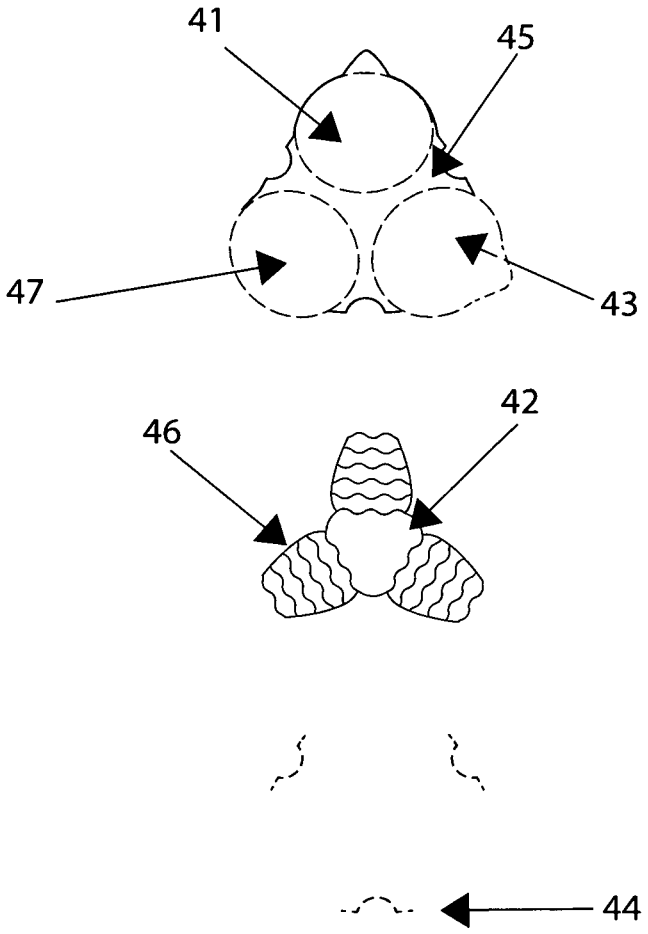
FIG. 4 is a front view of the pick's back surface shown in FIG. 1.

FIG. 4 shows three lobes 41, 42, and 47. The first illustration coextensively frames all three lobes 45. 42 illustrates a given surface texture within the collective grip pads. 46 illustrates a given surface texture on each gripping (pad) section that may be the same or different. The grooves for each lobe depicted in 44.

Figure 5:
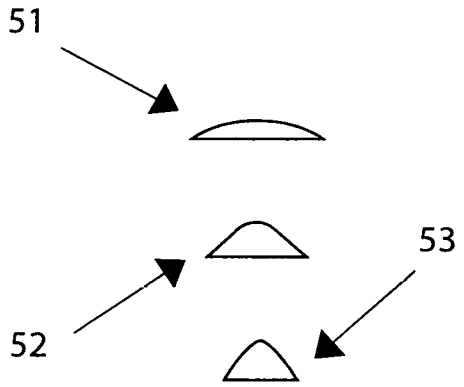
FIG. 5 is a front view of the guitar pick tips and corresponding radius(s).

FIG. 5, there are 3 different radius tips shown i.e. 51, 52, and 53. Each radius is manufactured with specific metrics that will vary pending upon the specific intended use and tone requirements.

Figure 6:
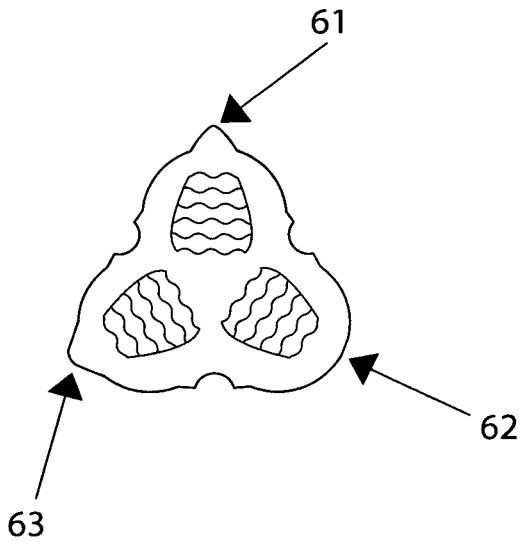
FIG. 6 is a front view of FIG. 3 according to an alternative embodiment.

FIG. 6 illustrates the aforementioned lobe tips (FIG. 5) per their associated corresponding concentric plane 61, 62, and 63. Specifically, 61 and 63 both depict lobes with pointed projections. Lobe sections associated with 61, 62, and 63 may or may not be beveled pending on the intended purpose of a chamfer inclusion i.e. an overlap that is used to soften the edge which comes in contact with a guitar string.

Figure 7:
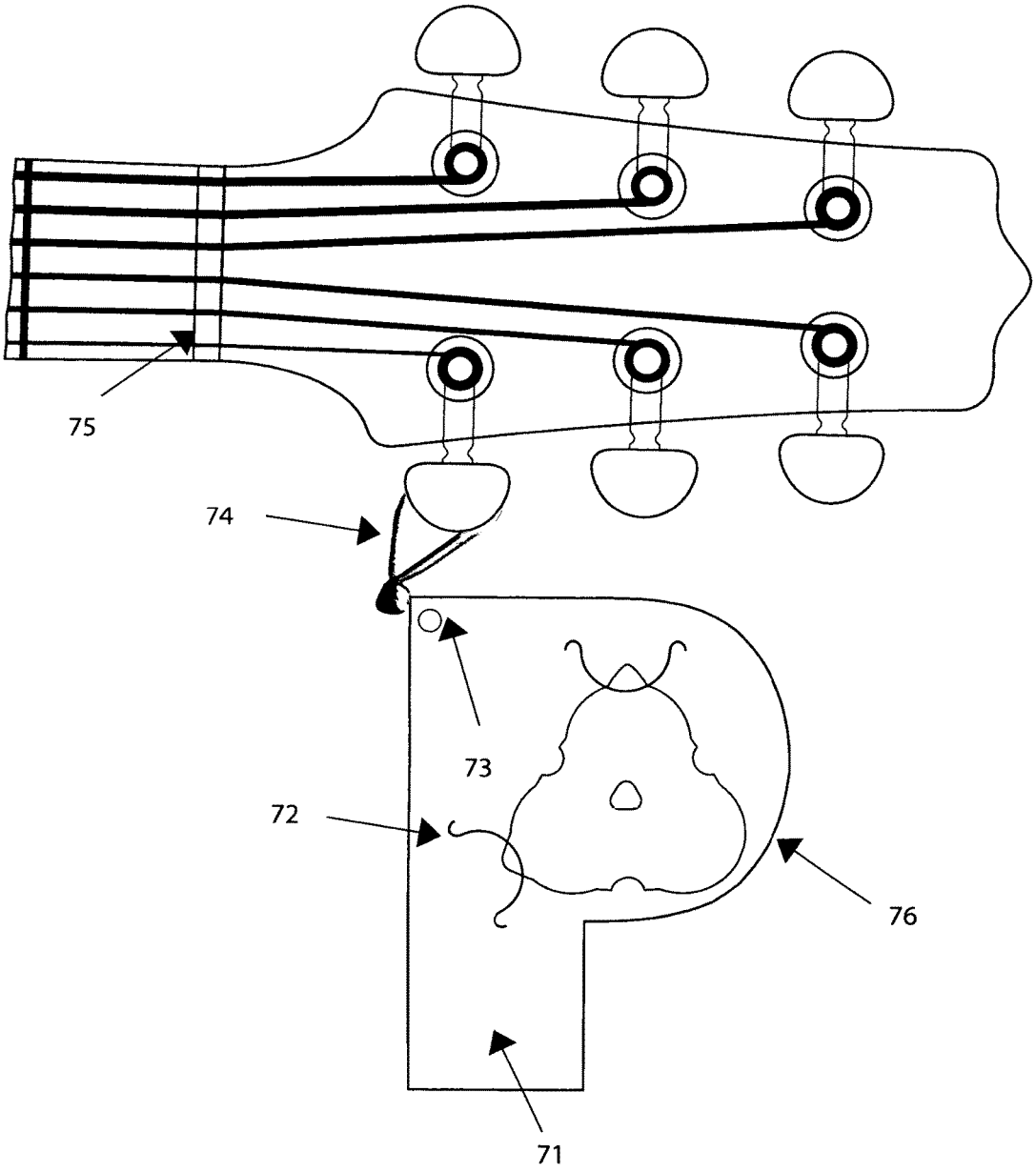
FIG. 7 is a frontal view of the guitar pick holder.

Referring now to FIG. 7, one embodiment of a guitar pick holder 76 is its' shape i.e. like a "P". Approximate dimension are 3"×2 2/8". Said guitar pick fits within the designated hoop like clips. Furthermore, the guitar pick holder is made of a material that provides both pliability and bend-ability.

Ideally, two card stock sheets are mounted whereby one or both sides may or may not provide specific brand advertisement. In parallel, a thin magnetic material can also be mounted securely affixed to backside. Finally, a polypropylene (plastic polymer) can be applied to one or both surfaces in order to increase the apparatus thickness, water-proofing, and/or additional rigidity requirement.

Affixed to the body of the pick holder is a unique"die-cut" resembling a flange 72 that when pressed upward allows for said pick tip to be placed securely. The two flanges act as a clip, holding 2 concentric planes with outward "arrow-like" pick tips. One flange is formed on the neck portion 71 of said "P" pick holder while the other is contained in the upper curvature section . . . 76. When the guitar pick is not in the"holder clip mechanism", the flanges fall back into a neutral position. Another feature 73 . . . shows an aperture in the upper left region of the apparatus and is used for attaching a string 74 thereon; enabling further attachment to a guitar. The shape itself"P" is intended to simply reinforce the obvious"Pick."

The holders functional strength is provided by surface area as well as material grain direction and the orientation in which it is die-cut optimizes rigidity i.e. bending of the flange-like hoops up and/or down without compromising the Integrity of the material. The holder can also be placed under the guitar strings 75 . . . where the apparatus has a magnetic contact surface and is thereby easily attached to a guitar's metal frets.

What is claimed:

1. A guitar pick, comprising:

a generally planar body, three equally spaced lobes, concentrically spaced from a mid-point and from each other by equally spaced grooves, wherein a first lobe is completely rounded, a second lobe has a relatively narrow pick projection, and the third lobe has a picking projection wider than the second lobe.

2. A pick as defined in claim 1, wherein each lobe has curved sides between its picking projections and all the curved sides are of the same length, wherein each lobe is concentrically spaced from a mid-point between lobes and from each other, wherein each lobe contains a distinctly shaped picking projection, wherein the pick comprises a smooth, planar surface texture, and the pick projections are identifiable by contour as well as edge sharpness.

3. The invention as defined in claim 2, wherein a silicone-rubber grip is utilized that is non-sticky and comfortable to hold, a high friction coating and raised surface, a grip pad utilized on one, two, or all three lobes, a configuration containing 3 lobes and 3 grip pads forms a semi-triangular shape, and wherein the surface found outside the grips collectively is a center area that is relatively flat and non-textured wherein coupling different textures and surface contact materials yields improved handling and articulation of strings.

4. A method of playing the three lobe pick of claim 2, comprising:

switching between lobes one to three in the same song by utilizing grooves to detect the currently used picking projection, a first lobe structured with a completely rounded tip for learners and for or achieving a warmer sound, a changeover to a second lobe that has a narrow pick projection ideal for lead lines and faster fanning all guitar strings, and a transition to a third lobe pick projection wider than the second one for strumming, wherein each tip structure affects a particular string resistance to plucking.

5. The method of playing the three lobe pick of claim 2, further comprising an up stroke to obtain a given tonal quality, and conversely a different picking projection utilized on a down stroke to attain a different tonal quality.

* * * * *